US006138903A

United States Patent [19]

Baker

[11] Patent Number: 6,138,903

[45] Date of Patent: Oct. 31, 2000

[54] MULTI-PLY CORRUGATED PAPERBOARD CONTAINER

[75] Inventor: Harold L. Baker, Longview, Wash.

[73] Assignee: Longview Fibre Company, Longview, Wash.

[21] Appl. No.: 09/137,627

[22] Filed: Aug. 21, 1998

[51] Int. Cl.[7] ..... B65D 5/42

[52] U.S. Cl. ..... 229/122.33; 229/122.27; 229/122.32; 229/930; 229/939; 493/95; 493/100

[58] Field of Search ..... 229/122.27, 122.32, 229/122.33, 185.1, 930, 939; 206/386; 493/89, 95, 96, 97, 94, 100; 220/FOR 153

[56] References Cited

U.S. PATENT DOCUMENTS

| | | | |
|---|---|---|---|
| 1,865,688 | 7/1932 | Hannaford | 229/122.33 |
| 3,385,504 | 5/1968 | Adams | 229/122.32 |
| 3,653,578 | 4/1972 | Wood | 229/122.33 |
| 3,744,702 | 7/1973 | Ellison | 229/122.32 |
| 3,910,482 | 10/1975 | Bamburg et al. | 229/122.32 |
| 4,260,442 | 4/1981 | Ford et al. | 493/97 |
| 4,601,407 | 7/1986 | Gillard | 229/930 |
| 4,693,413 | 9/1987 | McFarland et al. | 229/930 |
| 4,850,506 | 7/1989 | Heaps, Jr. et al. | 229/122.33 |
| 5,356,014 | 10/1994 | Berner | 229/122.32 |

FOREIGN PATENT DOCUMENTS

| | | | |
|---|---|---|---|
| 2191172 | 12/1987 | United Kingdom | 220/FOR 153 |

*Primary Examiner*—Gary E. Elkins
*Attorney, Agent, or Firm*—Chernoff, Vilhauer, McClung & Stenzel

[57] ABSTRACT

A multi-ply paperboard container for use as a bulk material bin has elongate rectangular cross-sectioned tubular inner and outer shells having walls that are spaced apart from one another. Rectangular panels, having a width less than the width of the walls of the shells, are located between and adhesively bonded to each overlying pair of walls. Thus, gaps are formed between the inner and outer shell at each corner of the container. The corners of the inner and outer shells are crushed to provide wide soft corners. These gaps and crushed corners permit the container to be easily knocked down to a flat configuration without a substantial amount of spring-back. The container includes a bottom cap having end flaps inserted between the inner and outer shells or between adjacent plies in the inner or outer shells, and the outer shell has closure flaps which fold over the bottom cap to keep the end flaps in place. When loaded, the bottom cap and closure flaps prevent the container walls from bending outwardly. The inner and outer shells are constructed from two-ply double wall corrugated material and the panels are constructed from one-ply double wall corrugated material. The inner liner on the inner ply of the inner shell is thicker than the liners of the other plies, and the inner ply of the inner shell has smaller flutes than the remaining plies preventing the inner ply from buckling when the walls are bent outwardly.

20 Claims, 6 Drawing Sheets

MULTI-PLY CORRUGATED PAPERBOARD CONTAINER

BACKGROUND AND SUMMARY OF THE INVENTION

Large multi-ply corrugated paperboard containers are commonly used as bins for storing and transporting bulk materials. These containers are typically shipped to the users in a flat "knocked down" configuration to save space. In addition, these containers are used multiple times and are knocked down between each use. However, it is difficult to provide a multi-layer container that has the strength and stiffness to carry large quantities of bulk material and yet is easily knocked down without it having a tendency to spring back to a partially erected position. One way of accomplishing this is by providing beveled corners at two opposed corners or at all four corners of the container. These beveled corners are created by crushing the corrugated material. A container of this type is shown in Gillard U.S. Pat. No. 4,601,407.

These prior art containers are manufactured by wrapping a strip of single-ply corrugated material around a mandrel having beveled corners, with each layer being adhesively bonded to the underlying layer. A plate is urged inwardly against the corners to crush them. While containers made by this technique can be knocked down relatively easy, they still have a tendency to spring back and an expensive sophisticated mechanism is required to construct them.

The subject invention provides a method for manufacturing an easily knocked down multi-ply corrugated container, and the resulting container, which does not require specialized equipment. The method includes providing overlying inner and outer elongate, rectangular cross-sectioned, tubular corrugated shells with the walls of the inner shell being spaced apart from the walls of the outer shell, and corrugated panels which are located between and adhesively adhered to adjacent walls of the inner and outer shells. The panels preferably have a width which is less than the width of the walls leaving a space between the inner and outer walls at each corner. This space allows the container to easily be knocked down. In a preferred embodiment, the corners of the inner and outer shells are crushed to provide a wide break line which creates soft corners in the shells which further facilitates knocking the containers down.

Preferably, the inner and outer shells are made from two-ply, double wall corrugated material and the panels are made from one-ply, double wall corrugated material. Insertion of the panels between the shells so that they are centered on the walls is facilitated by inserting a spacer between each adjacent inner and outer wall at the sides thereof before inserting the panels.

The resulting container preferably is enclosed with a bottom cap having end flaps which project upwardly between any two adjacent plies. The outer shell has downwardly extending closure flaps which are foldable over this bottom cap. The bottom cap and closure flaps prevent the sidewalls of the container from bowing out and the closure flaps also prevent the bottom cap end flaps from being pulled out from between the adjacent plies when the pallet on which a loaded container is moved before the container has been strapped to the pallet.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
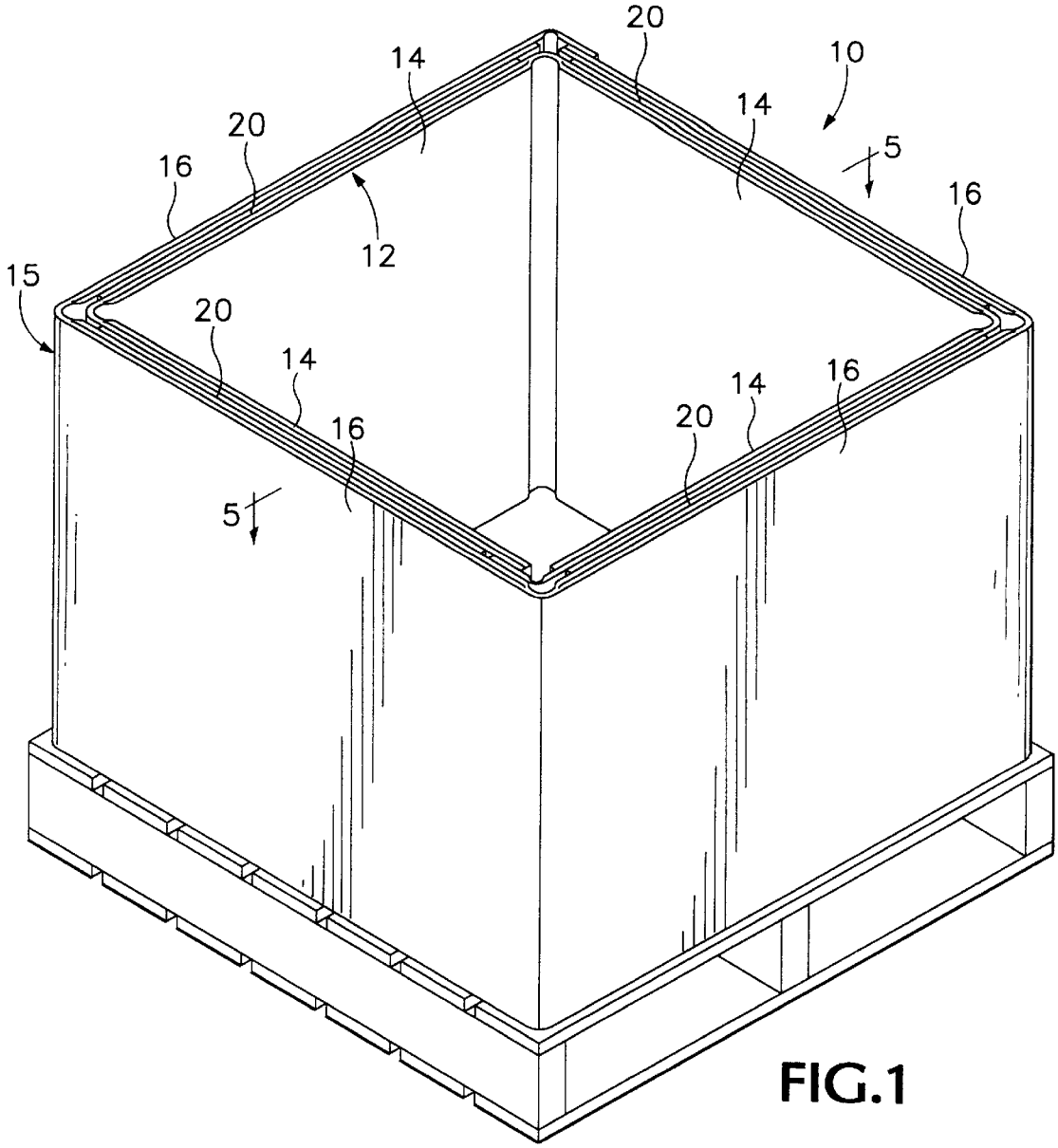
FIG. 1 is a perspective view of a container embodying the subject invention placed on a pallet.
Figure 5:
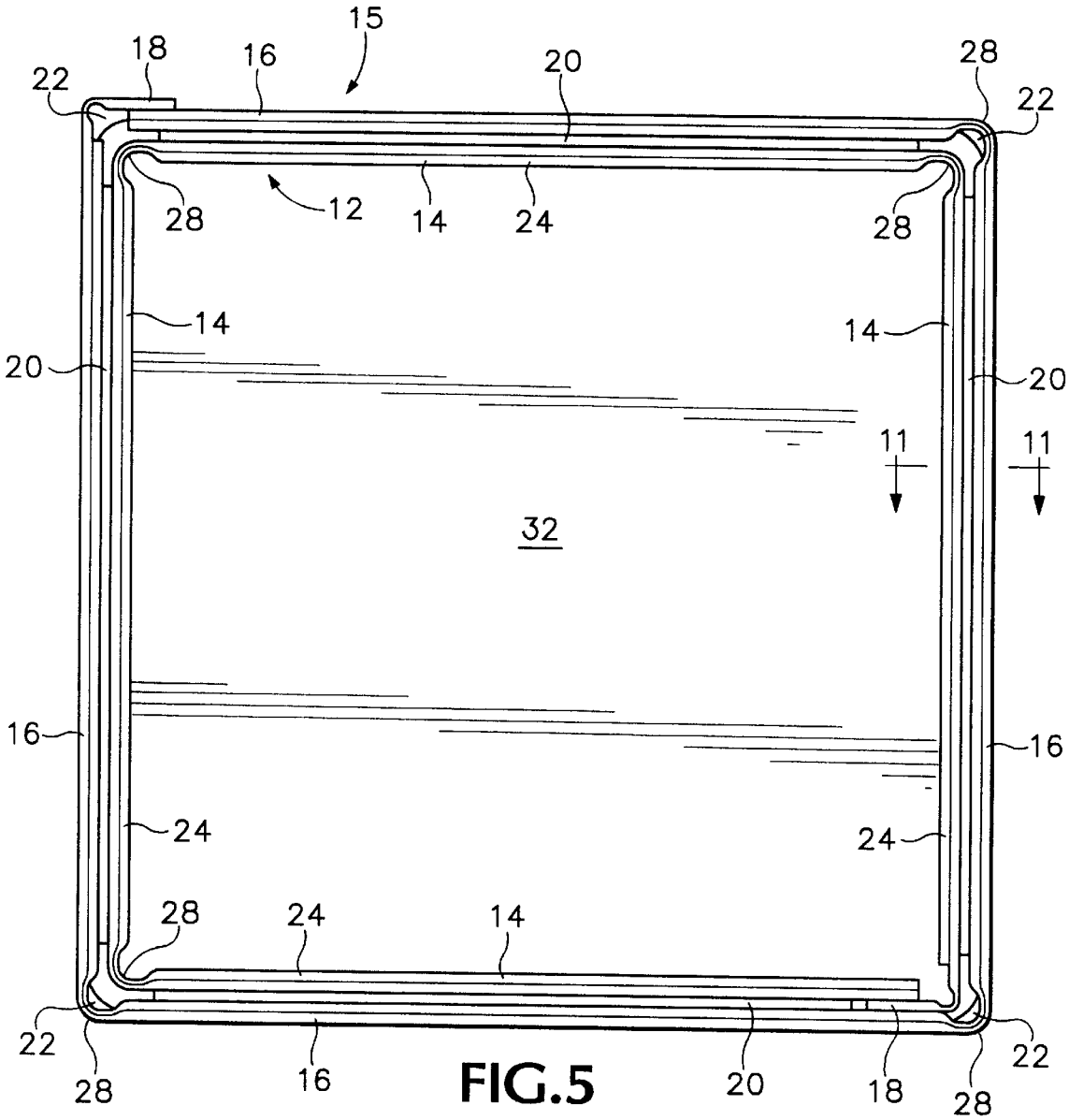
FIG. 5 is a cross-sectional view taken on the line 5—5 of FIG. 1.
Figure 6:
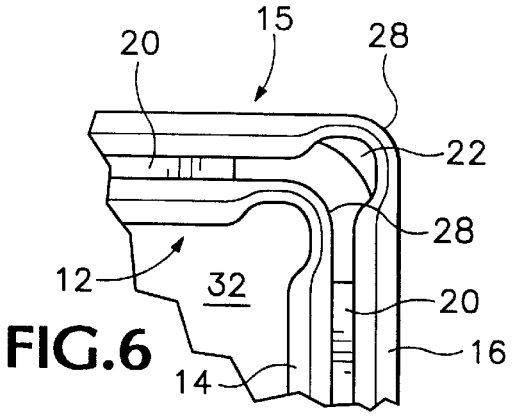
FIG. 6 is a detail view, at an enlarged scale, of one of the corners shown in FIG. 5.

Referring to FIG. 1 of the drawings, a multi-layer corrugated bulk container 10 is formed from an elongate, rectangular cross-sectioned, tubular inner shell 12 having four planar walls 14, and a similar outer shell 15 having four planar walls 16. The shells are formed from flat shell blanks (not shown) and one edge of each shell blank contains an end flap 18, FIG. 5, which overlaps and adhesively attaches to the opposite edge of the blank to form the tubular shell. The inner shell fits within the outer shell and the four walls of the outer shell are separated from the corresponding walls of the inner shell by a predetermined distance. Located between each corresponding inner and outer wall is a rectangular panel 20. The panels 20 have the same height as the shell walls 14, 16 but are narrower. Three of the panels have the same width and the fourth panel, which fits next to the flap 18, is narrower than the other panels. Because the panels are narrower than the shell walls 14, 16, gaps 22 are created between the inner and outer shell at each corner of the container. As will be explained more fully later, it is these gaps which allow the container to be knocked down without extensive spring-back.

Figure 11:
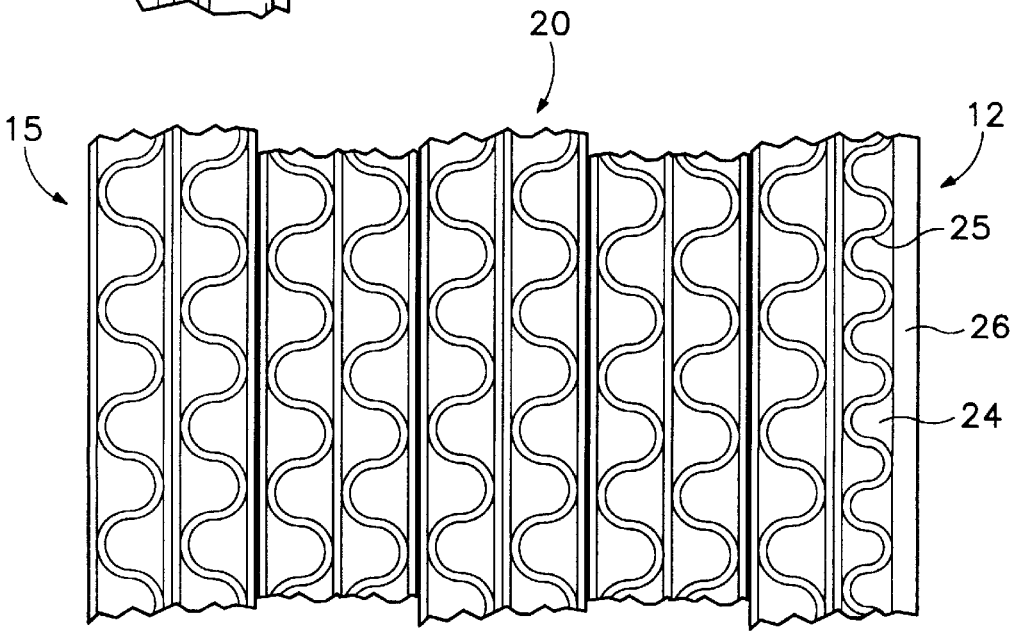
FIG. 11 is a cross-sectional view, at an enlarged scale taken on the line 11—11 of FIG. 5.
Figure 8:
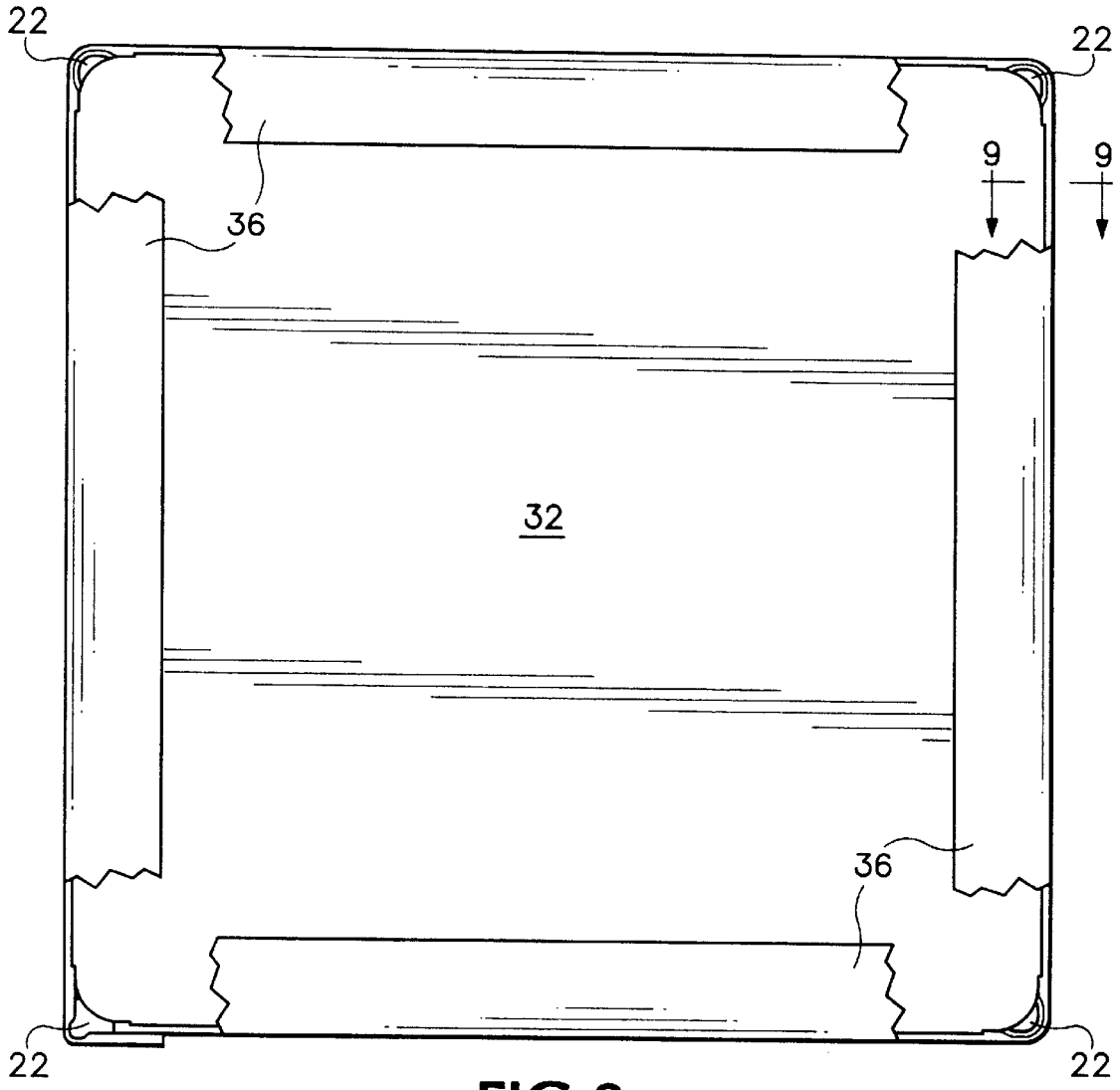
FIG. 8 is a bottom view of the container.

Referring now also to FIG. 11, in a preferred embodiment, the inner and outer shells 12, 15 are constructed from two-ply double wall corrugated and the panels 20 are constructed from single-ply double wall corrugated. The end flaps 18 are constructed from single-ply double wall corrugated to facilitate their being bent and to reduce the bulk of the overlapping joint. The inner ply 24 of the inner shell 12 has smaller flutes 25 than the other plies in the inner tube, and the liner 26 on the inner side of the inner shell is thicker than the other liners. When a multiple ply corrugated panel is bent concave out, the outer portion of the corrugated material is placed in tension and the inner portion is placed in compression. While the outer liners will never stretch enough to break, the inner liner can buckle which is how a corrugated panel fails when bent. Accordingly, by making the inner most liner thicker, bending strength is maximized for a given weight container. While larger flutes generally are thicker and thus stronger, corrugated panels with smaller flutes have less unsupported length and thus are less likely to buckle under compression. Thus, placing smaller flutes on the inner most ply maximizes bending strength for a given weight container.

Also, in a preferred embodiment, the corners 28 of the inner and outer shells 12, 15 are crushed to improve their flexibility and thus facilitate knocking down the container. This crushed portion should be quite wide, between one and three inches. A two and one-half inch crushed corner has been found to be optimal. The crushing is performed on the shell blanks when they are cut, and crushing of this type is a standard way to make fold lines in corrugated material.

The foregoing construction facilitates knocking down the container. The crushed corners 28 provide a softness which makes the corners more easily bent. More importantly, the fact that the outer shell 12 is not glued to the inner shell 14 at the corners and that there are gaps 22 between the inner and outer shells at the corners allows movement between the inner and outer shells at the corners which permits the container to be knocked down without substantial spring-back.

Figure 7:
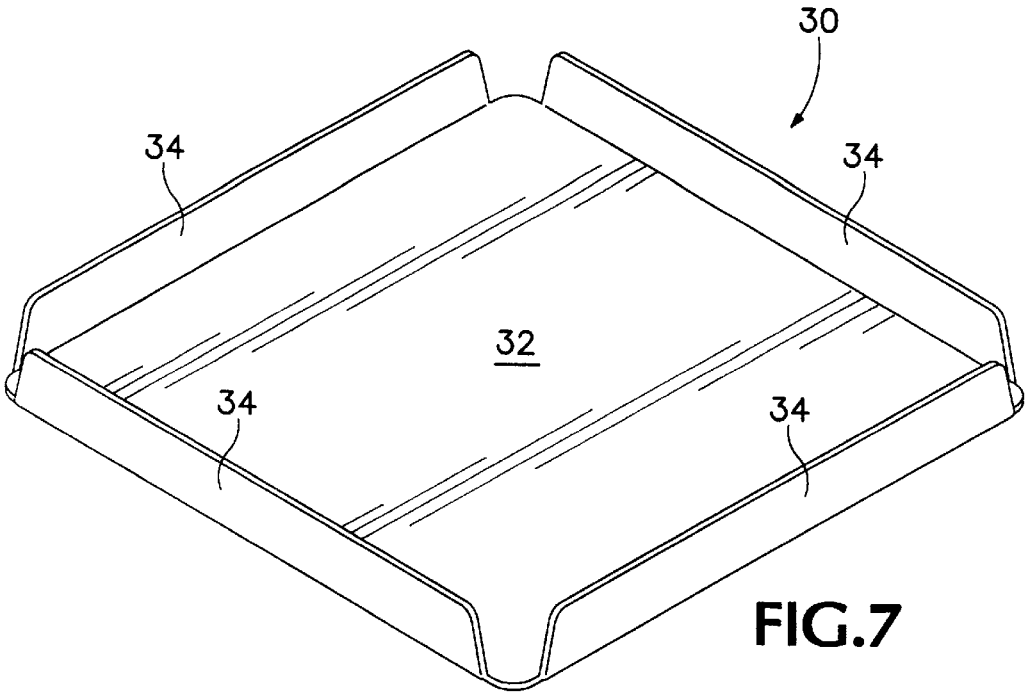
FIG. 7 is a perspective view of a bottom cap which is used on the container.
Figure 10:
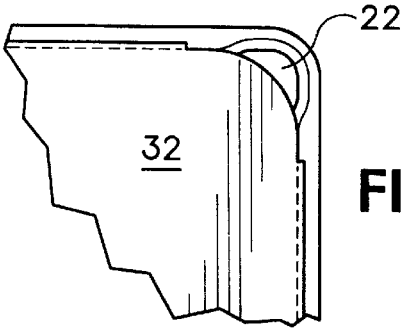
FIG. 10 is a detail view, at an enlarged scale, and partially broken away, of one of the corners shown in FIG. 8.

The bottom of the container is covered by a bottom cap 30, FIG. 7. The bottom cap has a rectangular bottom piece 32 with the same shape as the cross-sectional shape of the inner shell 12. End flaps 34, which extend upwardly from all four edges of the bottom piece 32, fit between any two adjacent plies. In a preferred embodiment shown, the lower extremity of one side of each panel 20 is not glued to facilitate insertion of the end flaps. In addition, the end flaps do not extend across the entire extent of the bottom piece 32 and they have tapered sidewalls and rounded corners, all of which facilitates their insertion between the inner and outer shells. Bottom caps of this type are common for enclosing the bottom ends of open-ended bulk storage bins and serve to resist outward bending of the container walls when the container is loaded.

Figure 9:
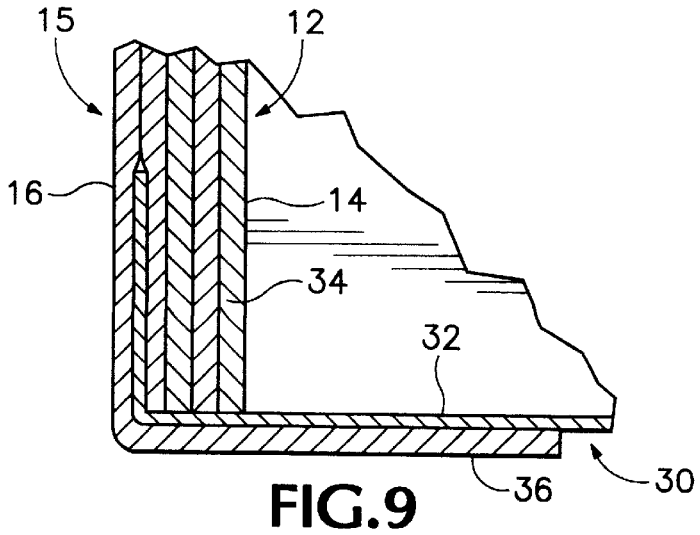
FIG. 9 is a cross-sectional view taken on the line 9—9 of FIG. 8.

To further resist outward bending of the container walls, the subject invention provides closure flaps 36, FIG. 9, which extend downwardly from the bottom extremity of each wall 16 of the outer shell 15 and are foldable over a portion of the bottom cap 30. The closure flaps are single-ply double wall corrugated to facilitate their being bent over the bottom cap. The closure flaps are substantially wider than the thickness of the combined inner and outer shells and panels, approximately eight inches in the preferred embodiment illustrated. Thus, when folded over at right angles to the walls 14, 16, the closure flaps stiffen the walls considerably and substantially prevent the walls from being bent outwardly by the load. In addition, when an erected container is placed on a pallet and loaded and the pallet is moved before the container is strapped to the pallet, the container can tip on the pallet and the end flaps 34 can pull out of the container. The closure flaps 36 prevent this from happening. When the container is loaded, a top cap (not shown) is placed on top of the container and the container is strapped to the pallet for shipping. When the container reaches its destination, the straps and top cap are removed and the container is unloaded. When the container is empty, it can be refilled again or knocked down for storage or shipping to another location for reuse.

Figure 2:
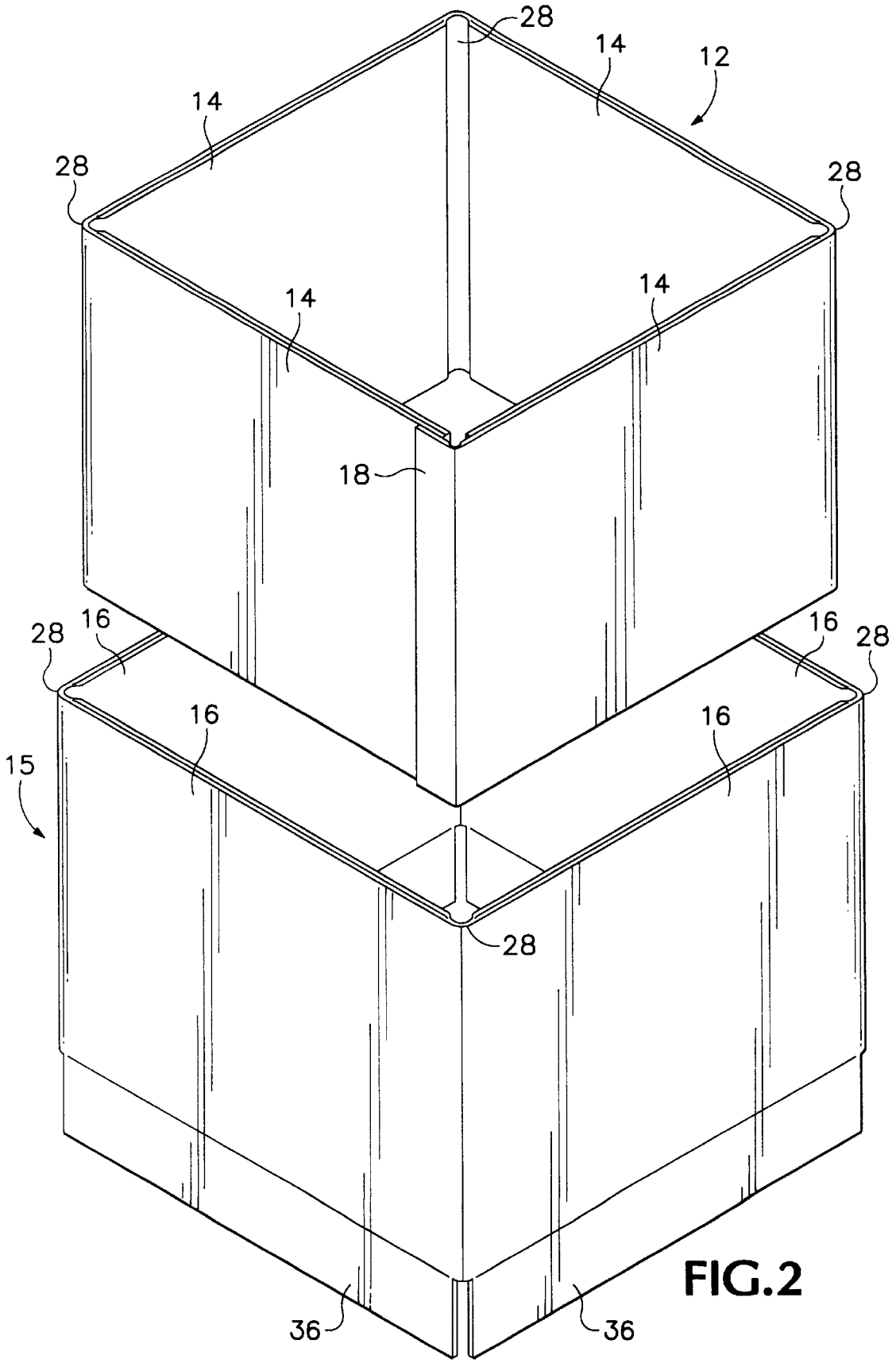
FIG. 2 is an exploded perspective view showing the first step in the method of making the container of the subject invention.
Figure 4:
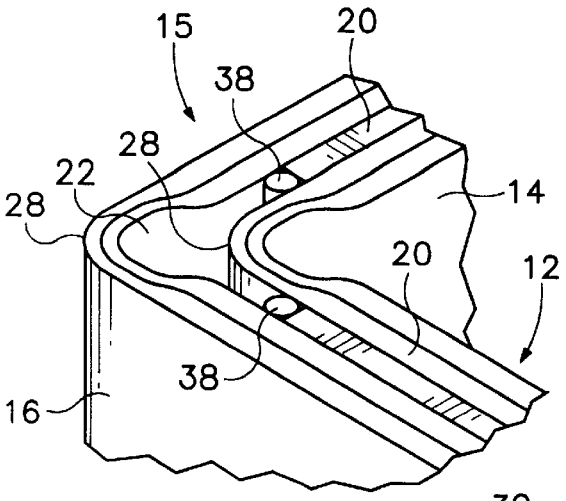
FIG. 4 is a detail view, at an enlarged scale, of one of the corners shown in FIG. 3.
Figure 3:
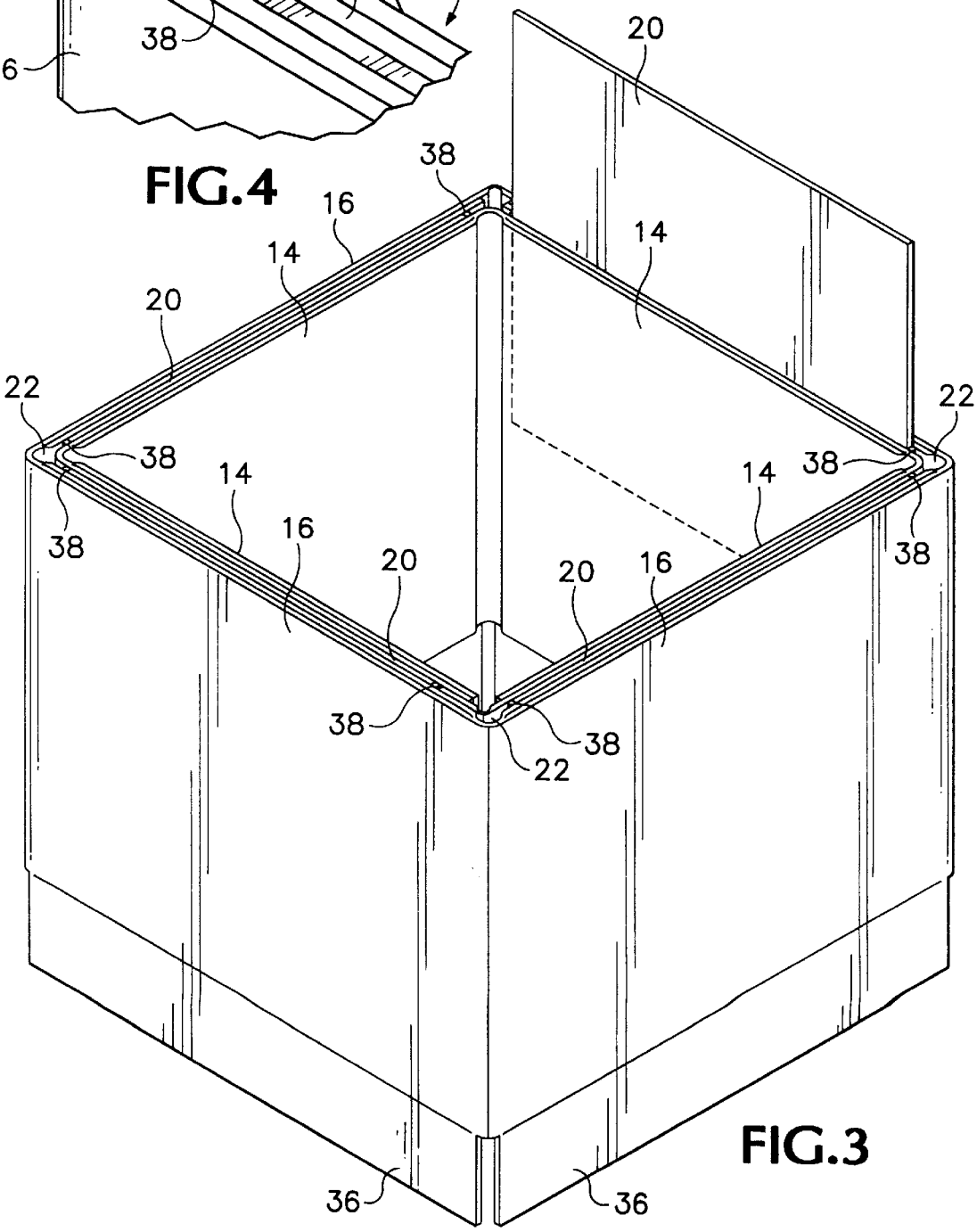
FIG. 3 is a perspective view showing the remaining steps in the construction of the container of the subject invention.

The method for constructing the subject container is shown in FIGS. 2 and 3. The inner and outer shells are first erected by gluing the end flaps 18 to the wall 14, 16 that they overlap and the inner shell is placed inside of the outer shell, FIG. 2. Spacers 38, having the same width as the predetermined distance between the inner and outer shells, are inserted between the inner and outer shells with one spacer being inserted at each end of each wall. The spacers center the inner shell in the outer shell which allows the panels 20 to be easily inserted between them. In addition, they insure that the panels are roughly centered on the respective walls so that uniform gaps 22 are formed at each corner. Adhesive is then applied to both sides of every panel, except the bottom portion of one side of each panel is left unglued to allow the bottom cap to be inserted, and the panels are inserted between the shells. Alternately, one side of the panels could be pre-glued to one of the shells. Glue would then be applied to the other side of the panels and the two shells combined. As the panels are inserted, the spacers 38 are removed. As a practical matter, it probably will be necessary to construct the container over a mandrel (not shown) that the inner shell fits tightly over so that plates can be urged against the outer walls to compress the various elements until adhesive sets.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for making a corrugated paperboard container comprising:

(a) Providing an elongate, rectangular cross-sectioned, corrugated paperboard tubular inner shell having two pair of planar opposed inner walls with first dimensions between outer surfaces of said opposed inner walls;

(b) providing an elongate, rectangular cross-sectioned, corrugated paperboard tubular outer shell having two pair of planer opposed outer walls with second dimensions between inner surfaces of said opposed outer walls, said second dimensions being greater than said first dimensions by a predetermined amount;

(c) placing said inner shell inside of said outer shell; and (d) inserting rectangular corrugated paperboard panels having glue applied to both sides thereof between each overlying wall of said inner and outer shell, said panels having a thickness which is approximately equal to one-half of said predetermined amount.

2. The method of claim 1 wherein said walls and said panels have a width and a height and the width of said panels is less than the width of said walls.

3. The method of claim 2 including the additional step of inserting a pair of spacers between each inner and outer wall prior to the insertion of one of said panels, one of said pair of spacers being at each side of said each inner and outer walls, in order to roughly center a panel on each inner and outer wall, and then removing said pair of spacers after the associated panel is in place.

4. The method of claim 1 wherein said inner and outer shells are made from two-ply double wall corrugated material and said panels are made from one-ply double wall corrugated material.

5. The method of claim 1 wherein fold lines are placed between adjacent ones of said walls before said shells are formed by crushing the corrugated material.

6. The method of claim 5 wherein said fold lines have a width of between one and three inches.

7. The method of claim 5 wherein said fold lines have a width of two and one-half inches.

8. A paperboard container comprising:

(a) A corrugated, elongate, rectangular cross-section, tubular inner shell having four inner walls;

(b) a corrugated, elongate, rectangular cross-section, tubular outer shell having four outer walls;

(c) said inner and outer walls having a height;

(d) each inner wall of said inner shell being spaced apart from one of said outer walls of said outer shell by a predetermined distance over substantially the entire height of said inner and outer panels; and (e) rectangular panels having a thickness approximately equal to said predetermined distance and a height substantially equal to the height of said inner and outer walls, one of said panels being between each inner and outer wall and being adhesively bonded thereto.

9. The container of claim 8 wherein said walls and said panels have a width which is less than the width of said walls.

10. The container of claim 8 wherein said inner and outer shells are two-ply double wall and said panels are single-ply double wall.

11. The container of claim 10 wherein the liner on the inner side of the inner shell is thicker than the remaining liners.

12. The container of claim 11 wherein the corrugation on the inner ply of the inner shell has smaller flutes than the corrugation in the remaining plies.

13. The container of claim 8 including fold lines located in said inner and outer shells between adjacent ones of said walls, said fold lines being crushed corrugation.

14. The container of claim 13 wherein said fold lines are between one and three inches wide.

15. The container of claim 13 wherein said fold lines are two and one-half inches wide.

16. The container of claim 8 further comprising:

(a) A bottom cap having a bottom piece with the same shape as the cross-sectional shape of said inner shell and end flaps which project upwardly from said bottom piece and extend between said inner and outer shells; and (b) closure flaps which extend from each of said outer walls of said outer shell and are folded over a portion of said bottom cap.

17. The container of claim 16 wherein adhesive is not applied to bottom portions of said panels to facilitate insertion of said end flaps between said inner and outer shells.

18. The container of claim 16 wherein said closure flaps are one-ply double wall corrugated material.

19. The container of claim 8 wherein at least one of said inner and outer shells has multiple plies, said container further comprising:

(a) A bottom cap having a bottom piece with the same shape as the cross-sectional shape of said inner shell and end flaps which project upwardly from said bottom piece and extend between adjacent ones of said multiple plies; and (b) Closure flaps which extend from each of said outer walls of said outer shell and are folded over a portion of said bottom cap.

20. The container of claim 19 wherein an adhesive is not applied to bottom portions of said plies to facilitate insertion of said end flaps between said adjacent ones of said multiple plies.

* * * * *